US009739293B2

(12) United States Patent
Wi et al.

(10) Patent No.: US 9,739,293 B2
(45) Date of Patent: Aug. 22, 2017

(54) CYLINDER

(71) Applicant: Hyundai Motor Company, Seoul (KR)

(72) Inventors: Kyung Chan Wi, Ulsan (KR); Byeong Ho Choi, Ulsan (KR)

(73) Assignee: Hyundai Motor Company, Seoul (KR)

( * ) Notice: Subject to any disclaimer, the term of this patent is extended or adjusted under 35 U.S.C. 154(b) by 15 days.

(21) Appl. No.: 14/929,597

(22) Filed: Nov. 2, 2015

(65) Prior Publication Data

US 2017/0051766 A1 Feb. 23, 2017

(30) Foreign Application Priority Data

Aug. 18, 2015 (KR) ..... 10-2015-0116106

(51) Int. Cl.
*F15B 15/14* (2006.01)

(52) U.S. Cl.
CPC ..... *F15B 15/1428* (2013.01); *F15B 15/149* (2013.01); *F15B 15/1433* (2013.01)

(58) Field of Classification Search
CPC .... F15B 15/1428; F15B 15/149; F15B 15/14; F15B 2215/30
USPC ..... 92/163
See application file for complete search history.

(56) References Cited

U.S. PATENT DOCUMENTS 2,536,565 A * 1/1951 Ostergren ..... B23B 31/302 285/13
2,803,223 A * 8/1957 Phelan ..... B62D 5/087 91/216 A
5,914,023 A * 6/1999 Roy ..... C25C 3/14 204/245

FOREIGN PATENT DOCUMENTS

| | | | |
|---|---|---|---|
| JP | 2000-074005 | A | 3/2000 |
| JP | 2001-182714 | A | 7/2001 |
| JP | 2003-329010 | A | 11/2003 |
| JP | 2008-025764 | A | 2/2008 |
| JP | 5035533 | B2 | 9/2012 |
| KR | 2003-0074370 | A | 9/2003 |
| KR | 10-0504251 | B1 | 8/2005 |

* cited by examiner

*Primary Examiner* — Thomas E Lazo
(74) *Attorney, Agent, or Firm* — Mintz Levin Cohn Ferris Glovsky and Popeo, P.C.; Peter F. Corless

(57) ABSTRACT

A cylinder is provided in which the length of a fluid supply pipe is reduced and the cylinder is installed in a fixed manner. The cylinder includes a main body that has an internal space and an upper supply aperture and a lower supply aperture through which fluid is supplied into the internal space. A piston is disposed between the upper supply aperture and the lower supply aperture to be vertically movable along the internal space. A rod is connected to the piston to transmit power produced by vertical movement of the piston to the exterior and a pipe extends from the upper supply aperture to a lower end of the main body.

12 Claims, 6 Drawing Sheets

CYLINDER

CROSS REFERENCE TO RELATED APPLICATION

The present application claims the benefit of and priority to Korean Patent Application No. 10-2015-0116106 filed on Aug. 18, 2015, the entire contents of which being incorporated herein for all purposes by this reference.

BACKGROUND

Technical Field

The present disclosure relates to a cylinder, and more particularly, to a cylinder configured such that the length of a fluid supply pipe that supplies fluid used for operating the cylinder is reduced and the cylinder is installed in a fixed manner, whereby the cylinder is reliably prevented from wobbling, and thus the durability thereof is improved.

Description of the Related Art

Generally, cylinders used in vehicle frame manufacturing equipment are configured such that a piston rod thereof is merely hinged to a clamp or the like, to which power is transmitted from the rod, and a main cylinder body is mounted to an external structure by a fixed hinge. In such a conventional cylinder installation structure, when the clamp is operated by forward and backward movement of the rod, the connection hinge between the clamp and the rod wobbles (e.g., is unstable), and such a motion is transmitted to the cylinder causing the main cylinder body to be unstable. Thus, the coupling of fluid pipes to the main cylinder body deteriorates, causing a reduction in durability. Moreover, due to such unstable movement, it may be difficult to use a foreign substance prevention cover. Therefore, the reduction in durability exacerbates, the operating ratio of the cylinder is reduced, and the maintainability thereof deteriorates.

The foregoing is intended merely to aid in the understanding of the background of the present disclosure, and is not intended to mean that the present disclosure falls within the purview of the related art that is already known to those skilled in the art.

SUMMARY

The present disclosure provides a cylinder which is configured such that the length of a fluid supply pipe that supplies fluid used for operating the cylinder may be reduced and the cylinder may be installed in a fixed manner, whereby the cylinder may be reliably prevented from wobbling, and thus the durability thereof may be improved.

In accordance with exemplary embodiments of the present disclosure, a cylinder may include: a main body having an internal space, and an upper supply aperture and a lower supply aperture through which fluid may be supplied from an exterior into the internal space or discharged from the internal space to the exterior; a piston disposed between the upper supply aperture and the lower supply aperture to be vertically movable along a sidewall of the internal space; a rod connected at a first end thereof to the piston and having a region exposed to the exterior from an upper end of the main body to transmit power produced by vertical movement of the piston to the exterior through the rod; and a pipe connected at a first end thereof to the upper supply aperture and extending to a lower end of the main body.

The piston may be moved upward or downward (e.g., vertically) by fluid that is supplied and discharged through the lower supply aperture and a second end of the pipe. The lower supply aperture may include a first lower supply aperture formed to pass through a bottom part of the main body, and a second lower supply aperture formed to pass through a side surface part of the main body. The main body may have, in the lower end thereof, a first through aperture formed in a region that does not overlap the internal space, wherein a first end of the first through aperture may be connected to a second end of the pipe, and the fluid may be supplied to and discharged from a second end of the first through aperture.

The first end of the first through aperture may be formed in the side surface part of the main body, and the second end of the first through aperture may be formed in the bottom part of the main body. The main body may have, in the bottom part thereof, at least one second through aperture formed in a region that does not overlap the internal space of the cylinder, and through which the first through aperture communicates with the exterior, wherein the fluid may be supplied to and discharged from an outer end of the second through aperture. The second end of the first through aperture may be formed in the bottom part of the main body, and the outer end of the second through aperture may be formed in the side surface part of the main body.

The cylinder may further include a floating link hinged at a first end thereof to a second end of the rod to be rotatable in one direction. A hinge connector may be disposed on a second end of the floating link to be rotatable in a direction equal to the direction in which the first end of the floating link is rotated. The cylinder may further include a cylinder fixing unit disposed to fix the main body to other structures. The cylinder fixing unit may extend from the main body in the direction in which the first end of the floating link is rotated.

Furthermore, in accordance with exemplary embodiments of the present disclosure, a cylinder may include: a main body defining therein an internal space in which a piston may be disposed and having an upper supply aperture and a lower supply aperture through which fluid may be respectively supplied from an exterior into an upper portion and a lower portion of a piston movement region to move the piston upward or downward (e.g., vertically); and a pipe that extends from the upper supply aperture to a lower end of the main body, wherein fluid may be supplied into or discharged from the internal space through the pipe and the lower supply aperture at the lower end of the main body to move the piston upward or downward. The cylinder may further include: a rod having a first end connected to the piston, and a second end exposed out of the main body; and a floating link hinged at a first end thereof to the second end of the rod to be rotatable in one direction. The cylinder may further include a cylinder fixing unit provided to fix the main body to other structures.

As described above, in a cylinder according to the present disclosure, fluid pipes through which fluid may be supplied into or discharged from upper and lower portions of an internal space of the cylinder may be installed on the lower end of the cylinder at positions adjacent to each other. Therefore, the lengths of the fluid pipes may be reduced, and the connection of the fluid pipes to the cylinder may be maintained more reliably. Furthermore, the cylinder according to the exemplary embodiment of the present disclosure may include multiple passages for connection with fluid pipes. Therefore, the flow rate at which fluid is supplied into or discharged from the cylinder may be increased, whereby the speed at which the cylinder is operated may be enhanced.

Moreover, in the cylinder according to the present disclosure, a floating link may be used on the end of a piston rod, thus making it possible for the cylinder to be installed in a fixed manner. Thereby, the cylinder may be prevented from wobbling (e.g., unstable movement) when operated. Consequently, various problems resulting from wobbling may be solved. In addition, a cover may be installed on the cylinder increasing the durability of the cylinder and facilitating maintenance thereof.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

It is understood that the tem "vehicle" or "vehicular" or other similar tem as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the tem "and/of" includes any and all combinations of one or more of the associated listed items.

Hereinafter, a cylinder according to an exemplary embodiment of the present disclosure will be described in detail with reference to the attached drawings.

Figure 1:
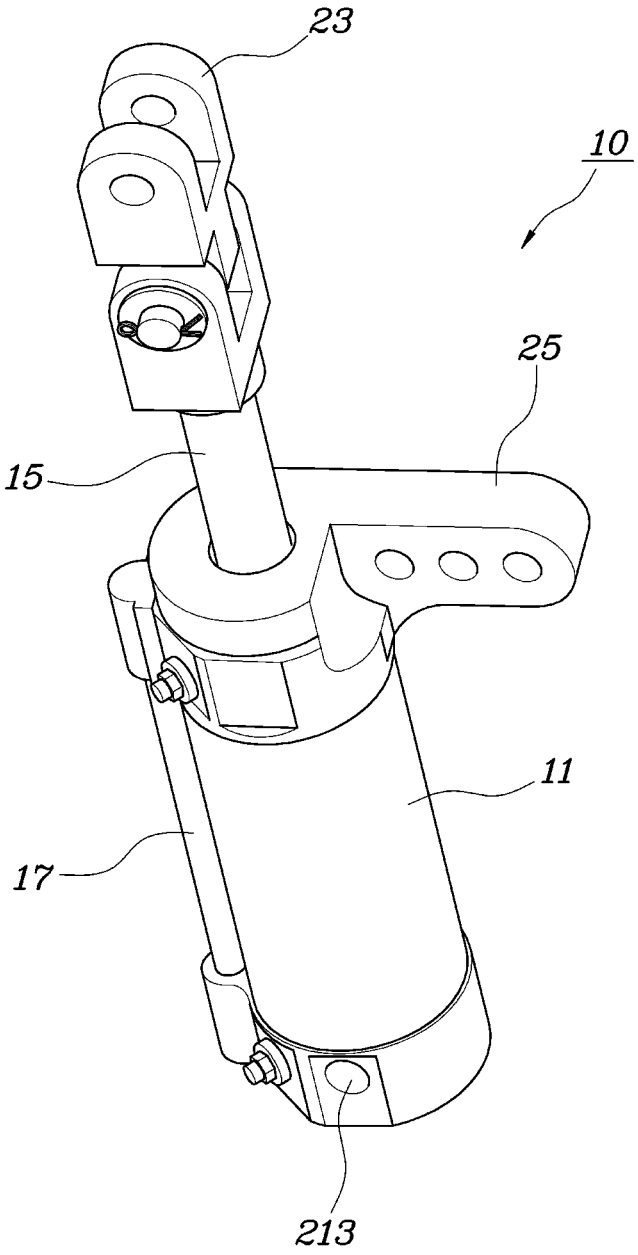
FIG. 1 is a view showing a cylinder according to an exemplary embodiment of the present disclosure.
Figure 2:
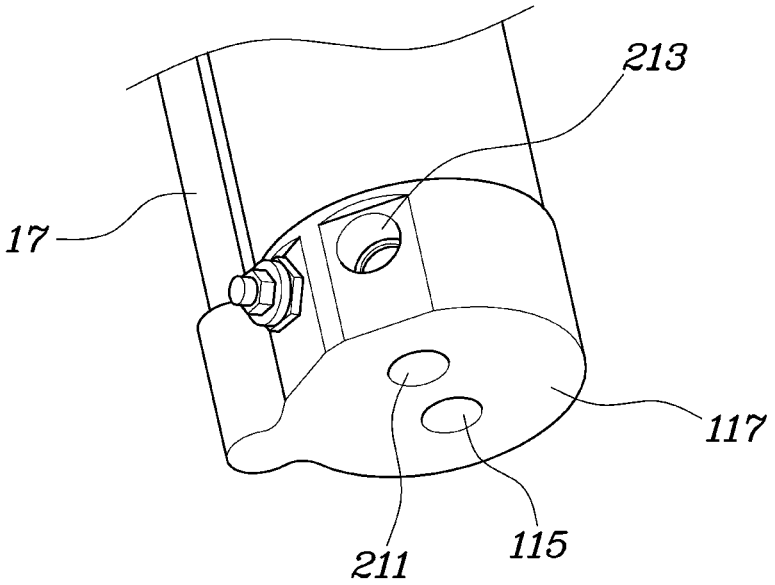
FIG. 2 is an enlarged bottom view showing the cylinder according to the exemplary embodiment of the present disclosure.
Figure 3:
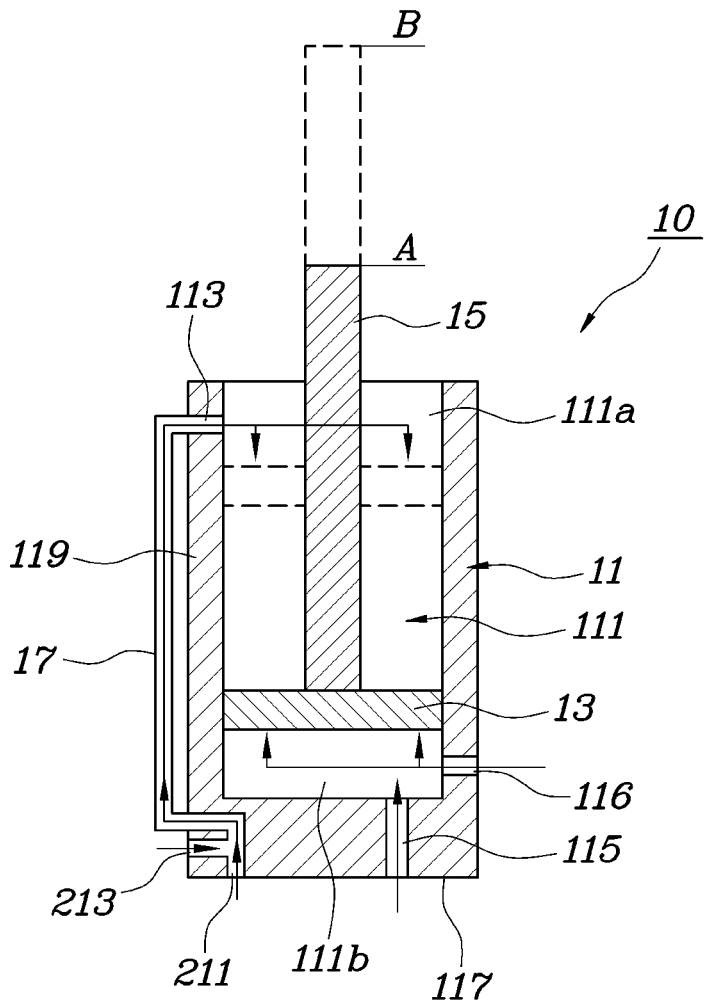
FIG. 3 is a sectional view illustrating the cylinder according to the exemplary embodiment of the present disclosure.

FIG. 1 is a view showing the cylinder according to the exemplary embodiment of the present disclosure. FIG. 2 is an enlarged bottom view showing the cylinder according to the exemplary embodiment of the present disclosure. FIG. 3 is a sectional view illustrating the cylinder according to the exemplary embodiment of the present disclosure.

Retelling to FIGS. 1 to 3, the cylinder 10 according to the exemplary embodiment of the present disclosure includes: a main body 11 which defines therein an internal space 111 in which a piston 13 may be disposed and may have an upper supply aperture 113 and a lower supply aperture 115 through which fluid is respectively supplied from the exterior into an upper portion 111*a* and a lower portion 111*b* of a piston movement region to move the piston 13 upward or downward (e.g., vertically); and a pipe 17 which extends from the upper supply aperture 113 to a lower end of the main body 11.

The cylinder 10 according to the present exemplary embodiment having the above-mentioned configuration may move the piston 13 vertically by supplying fluid from the lower end of the main body into the internal space 111 through the pipe 17 or the lower supply aperture 119 and discharging fluid from the internal space 111 to the exterior through the pipe 17 or the lower supply aperture 115.

In particular, the cylinder 10 according to the exemplary embodiment of the present disclosure may include: the main body 11 which has the internal space 111, and the upper and lower supply apertures 113 and 115 through which fluid is supplied from the exterior into the internal space 111 and discharged from the internal space 111 to the exterior; the piston 13 disposed between the upper and lower supply apertures 113 and 115 to be vertically movable along a sidewall of the internal space 11; a rod 15 connected at a first end thereof to the piston 13 and has a region exposed to the exterior from an upper end of the main body 11 to transmit the power produced by vertical movement of the piston 13 to the exterior through the rod 15; and the pipe 17 connected at a first end thereof to the upper supply aperture 113 and extends to the lower end of the main body 11.

In the cylinder 10 according to the present exemplary embodiment having the above-mentioned configuration, the piston 13 may be moved vertically by fluid which is supplied or discharged through the lower supply aperture 115 and a second end of the pipe 17 disposed in the lower end of the main body 11. Due to the above-mentioned structure, positions, at which fluid pipes (not shown) for supplying/discharging fluid into/from the upper and lower internal spaces 111*a* and 111*b* are connected to the cylinder 10, may be in the lower end of the cylinder 10. Therefore, compared to the conventional structure in which a fluid pipe through which fluid is supplied into the upper internal space 111*a* or discharged therefrom to the exterior is directly connected to the upper end of the cylinder, the length of the path of the fluid pipes may be reduced significantly. Due to the simplification of the path of the fluid pipes, the connection of the fluid pipes to the cylinder may be maintained more reliably.

To simplify the path of the fluid pipes, the main body 11 may include a first aperture (e.g., through-hole) 211 connected to the corresponding fluid pipe and the pipe 17. The first aperture 211 may be formed in the lower end of the main body 11 in a region that does not overlap the internal space 111 of the main body 11. The first aperture 211 may include a first end connected to a lower end of the pipe 17, and a second end through which fluid is supplied from or discharged to the corresponding fluid pipe. The first end of the first aperture 211 connected to the pipe 17 may be formed in a side surface part of the main body 11, and the second end of the first aperture 211 may be formed in a bottom part of the main body 11.

In this structure, when the lower supply aperture 115 is formed in the bottom part 117 of the main body 11 of the cylinder 10 and the lower supply aperture 115 communicates with the internal space 111, the fluid pipes through which fluid is respectively supplied into or discharged from the upper and lower internal spaces 111*a* and 111*b* may be connected together to the bottom part 117 of the main body 11 of the cylinder 10. In other words, with regard to supply of fluid into the upper internal space 111*a* of the cylinder 10, fluid supplied from the corresponding fluid pipe may be drawn into the first end of the first aperture 211 formed in the bottom part 117 of the main body 11 and may then be provided to the upper supply aperture 113 via the first aperture 211 and the pipe 17. Furthermore, with regard to supply of fluid into the lower internal space 111*b* of the cylinder 10, fluid may be supplied into the lower internal space 111*b* through the fluid pipe connected to the lower supply aperture 115 formed in the bottom part 117 of the main body 11 and may communicate with the lower internal space 111*b*. In other words, the two fluid pipes may be coupled together to the bottom part 117 of the main body 11. Consequently, the path of the fluid pipes may be simplified, whereby the connection of the fluid pipes to the cylinder may be maintained more reliably.

The main body 11 of the cylinder 10 according to the present exemplary embodiment may further include at least one second aperture 213 (e.g., through-hole), formed in the bottom part of the main body 11 in a region that does not overlap the internal space of the cylinder 11, and through which the first aperture 211 communicates with the exterior. A fluid pipe may be connected to an outer end of the second aperture 213 to allow supply and discharge of fluid. The end of the first aperture 211 connected to the corresponding fluid pipe may be formed in the bottom part 117 of the main body 11 and the outer end of the second aperture 213 may be formed in the side surface part of the main body 11.

Likewise, the lower supply aperture may also include a first lower supply aperture 115 formed in the bottom part 117 of the main body 11, and a second lower supply aperture 116 formed in the side surface part 119 of the main body 11. Each of the first and second lower supply apertures 115 and 116 may enable communication between the lower internal space 111*b* of the main body 11 and the exterior of the main body 11. Accordingly, in the present exemplary embodiment of the present disclosure, the multiple passages may be provided that are connected to the fluid pipes for supply and discharge of fluid. Each passage may be selectively used based on the flow rate of fluid supplied to the cylinder. Particularly, when all of the passages for supply of fluid are used, the flow rate of fluid supplied into/discharged from the cylinder may be increased, thus the speed of the piston 13 and the rod 15 may be increased.

Meanwhile, the cylinder 10 according to the exemplary embodiment of the present disclosure may further include a floating link 23 hinged at a first end thereof to a second end of the rod 15 to be rotatable in one direction. A hinge connector may be disposed on a second end of the floating link 23 to be rotatable in the same direction as the direction in which the first end of the floating link 23 connected to the rod 15 is rotated. Further, the opposite ends of the floating link 23 may be rotatably provided by the hinge connection without being fixed. Therefore, the floating link 23 may be configured to transmit power to other structures by vertical movement of the rod 15 even in conditions in which the cylinder 11 is completely fixed.

The cylinder 10 according to the exemplary embodiment of the present disclosure may be fixed in position due to the use of a floating link 23 rather than being provided to be movable using a separate hinge. Accordingly, the cylinder 11 according to the exemplary embodiment of the present disclosure may further include a cylinder fixing unit 25 configured to fix the cylinder 11 to other structures. The cylinder fixing unit 25 may include a structure which extends from the cylinder 10 in the transverse direction of the cylinder 10, and a fixing aperture formed within the structure. The position at which the cylinder fixing unit 25 is disposed on the cylinder 10 may be varied. Particularly, the cylinder fixing unit 25 may be embodied in a form in which it extends from the main body 11 in the direction in which the floating link 23 is rotated, to allow the cylinder 10 to be easily applied to a work environment in which the cylinder 10 is mainly used.

Figure 4:
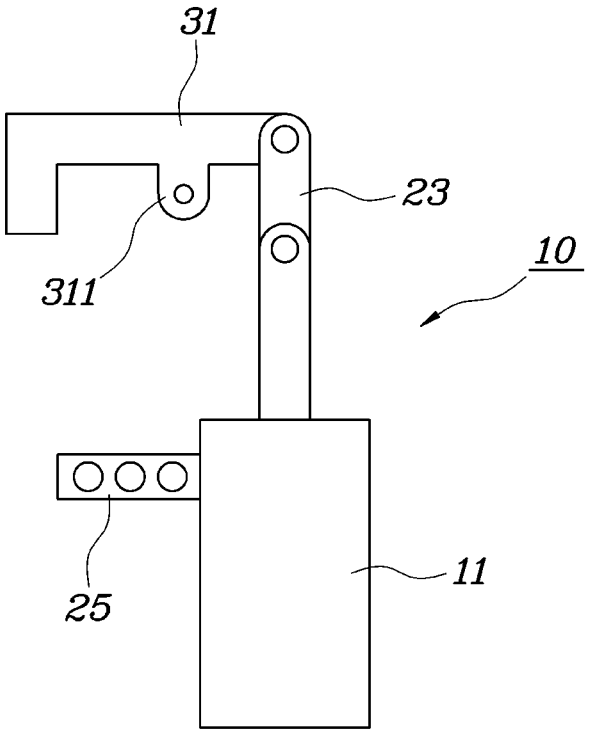
FIGS. 4 to 6 are views illustrating the operation of an application example of the cylinder according to the exemplary embodiment of the present disclosure.
Figure 5:
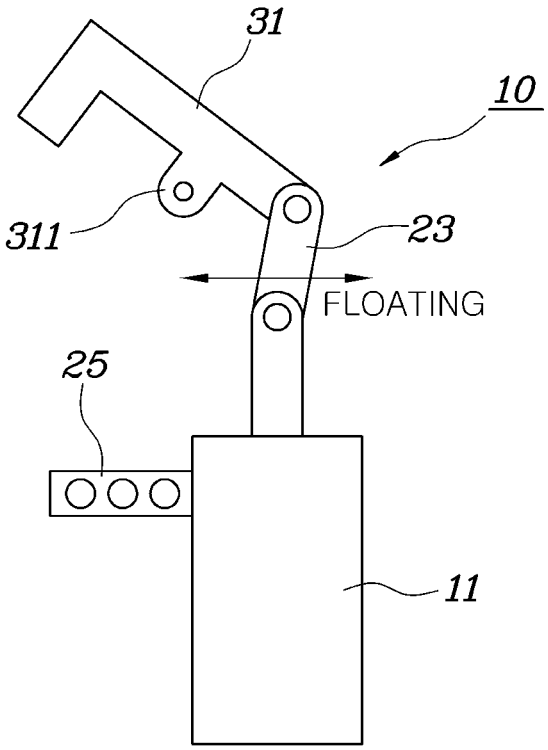
Figure 6:
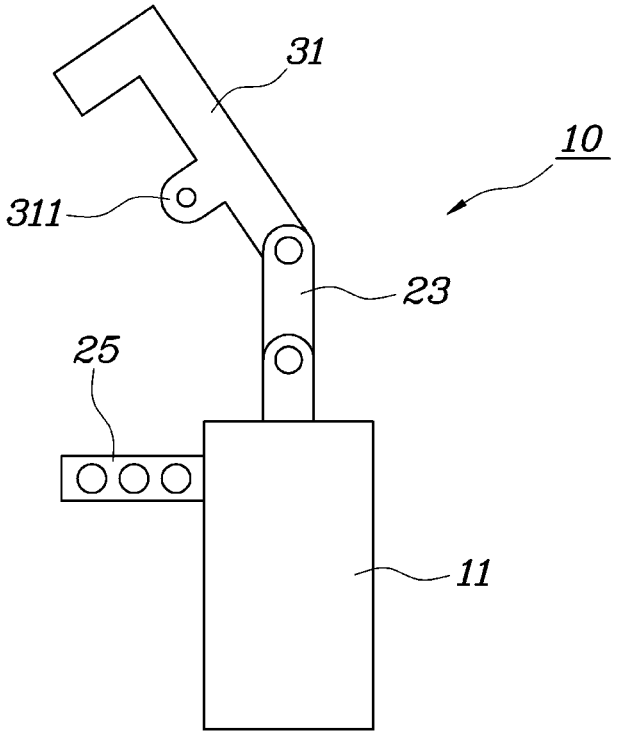

FIGS. 4 to 6 are views illustrating the operation of an application example of the cylinder according to the exemplary embodiment of the present disclosure. First, referring to FIG. 4, in the cylinder 10 according to the exemplary embodiment of the present disclosure, when fluid is supplied to the lower supply aperture 115, the piston may be moved upward, thus positioning the rod 15 in an upwardly advanced position. The cylinder fixing unit 25 of the cylinder 10 may be filially fixed to an external specific structure to allow the main body 11 to be reliably prevented from undesirably moving (e.g., wobbly or other unstable movement). Furthermore, when the rod 15 is moved to an uppermost position, the floating link 23 may be aligned with the rod 15 in the axial direction of the rod 15. In the present exemplary embodiment, the second end of the floating link 23 may be hinged to a first end of a one-hinge clamp 31 provided to be rotatable by a fixed hinge 311.

Thereafter, to lift a second end of the one-hinge clamp 31, as shown in FIG. 5, when fluid is supplied to the first aperture 211 and/or the second aperture 213, the fluid may be drawn into the upper internal space 111*a* of the cylinder, and fluid that has been present in the lower internal space 11*b* may be discharged to the exterior through the lower supply aperture 115. Then, the piston 13 may be moved downward. Consequently, the rod 15 may also be moved downward. The opposite ends of the floating link 23 may be rotated in a floating state by the non-fixed hinge connection. Thus, the one-hinge clamp 31 rotatably provided by the fixed hinge 311 may be rotated with the first end thereof moved downward and the second end thereof moved upward. Due to such operation of the floating link 23, the cylinder 10 may be operated even in conditions in which the main body 11 of the cylinder 10 is completely fixed.

Subsequently, as shown in FIG. 6, the piston 13 and the rod 15 of the cylinder 10 may be moved to a lowermost position and enter a completely retracted state. In particular, the first end of the one-hinge clamp 23 may be moved to the lowermost position, and the second end thereof may be moved to the uppermost position. In addition, the floating link 23 may also be aligned with the rod 15 in the axial direction of the rod 15.

As described above, in the cylinder 10 according to the exemplary embodiment of the present disclosure, fluid pipes through which fluid is supplied into or discharged from the upper and lower portions of the internal space of the cylinder may be installed on the lower end of the cylinder at positions adjacent to each other. Therefore, the lengths of the fluid pipes may be reduced, and the connection of the fluid pipes to the cylinder may be maintained more reliably. Furthermore, the cylinder 10 according to the exemplary embodiment of the present disclosure may include multiple passages for connection with fluid pipes. Therefore, the flow rate at which fluid is supplied into or discharged from the cylinder may be increased and thus, the speed at which the cylinder is operated may be improved.

Moreover, in the cylinder 10 according to the exemplary embodiment of the present disclosure, the floating link 23 may be disposed on the end of the rod 15, thus making it possible for the cylinder 10 to be installed in a fixed manner. The cylinder 10 may therefore be prevented from wobbling when operated. Consequently, various problems resulting from wobbling may be solved. Additionally, a cover may be installed on the cylinder and thus, the durability of the cylinder may be improved and maintenance thereof may be facilitated.

Although an exemplary embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. A cylinder, comprising:

a main body having an internal space, and an upper supply aperture and a lower supply aperture through which fluid is supplied from an exterior into the internal space or discharged from the internal space to the exterior;

a piston disposed between the upper supply aperture and the lower supply aperture to be vertically movable along a sidewall of the internal space;

a rod having a first end connected to the piston and having a region exposed to the exterior from an upper end of the main body to transmit power produced by vertical movement of the piston to the exterior through the rod;

a pipe having a first end connected to the upper supply aperture and extending to a lower end of the main body; and a floating link having a first end binged to a second end of the rod to be rotatable in one direction.

2. The cylinder according to claim 1, wherein the piston is moved vertically by fluid that is supplied and discharged through the lower supply aperture and a second end of the pipe.

3. The cylinder according to claim 1, wherein the lower supply aperture includes a first lower supply aperture formed to pass through a bottom part of the main body, and a second lower supply aperture formed to pass through a side surface part of the main body.

4. The cylinder according to claim 1, wherein the lower end of the main body includes a first aperture formed in a region that does not overlap the internal space, a first end of the first aperture is connected to a second end of the pipe, and the fluid is supplied to and discharged from a second end of the first aperture.

5. The cylinder according to claim 4, wherein the first end of the first aperture is formed in the side surface part of the main body, and the second end of the first aperture is formed in the bottom part of the main body.

6. The cylinder according to claim 4, wherein the bottom part of the main body includes at least one second aperture formed in a region that does not overlap the internal space of the cylinder, and through which the first aperture communicates with the exterior, wherein the fluid is supplied to and discharged from an outer end of the second aperture.

7. The cylinder according to claim 6, wherein the second end of the first aperture is formed in the bottom part of the main body, and the outer end of the second aperture is formed in the side surface part of the main body.

8. The cylinder according to claim 1, wherein a hinge connector is disposed on a second end of the floating link to be rotatable in a direction equal to the direction in which the first end of the floating link is rotated.

9. The cylinder according to claim 1, further comprising:

a cylinder fixing unit disposed to fix the main body to other structures.

10. The cylinder according to claim 9, wherein the cylinder fixing unit extends from the main body in the direction in which the first end of the floating link is rotated.

11. A cylinder, comprising:

a main body defining therein an internal space in which a piston is disposed and having an upper supply aperture and a lower supply aperture through which fluid is respectively supplied from an exterior into an upper portion and a lower portion of a piston movement region to move the piston vertically;

a pipe extending from the upper supply aperture to a lower end of the main body; and a cylinder fixing unit disposed to fix the main body to other structures, wherein fluid is supplied into or discharged from the internal space through the pipe and the lower supply aperture at the lower end of the main body to move the piston vertically.

12. The cylinder according to claim 11, further comprising:

a rod having a first end connected to the piston, and a second end exposed out of the main body; and a floating link having a first end hinged to the second end of the rod to be rotatable in one direction.

* * * * *